US007090555B2

(12) United States Patent
Lee et al.

(10) Patent No.: US 7,090,555 B2
(45) Date of Patent: Aug. 15, 2006

(54) METHOD OF FABRICATING FIELD EMISSION DISPLAY HAVING A GRID PLATE

(75) Inventors: Chun-Tao Lee, Hsinchu (TW); Ming-Chun Hsiao, Hsinchu (TW); Wei-Yi Lin, Yunlin (TW); Yu-Yang Chang, Tainan (TW); Yu-Wu Wang, Taichung (TW)

(73) Assignee: Industrial Technology Research Institute, Hsinchu (TW)

( * ) Notice: Subject to any disclaimer, the term of this patent is extended or adjusted under 35 U.S.C. 154(b) by 157 days.

(21) Appl. No.: 10/683,439

(22) Filed: Oct. 14, 2003

(65) Prior Publication Data

US 2004/0222732 A1 Nov. 11, 2004

(30) Foreign Application Priority Data

May 6, 2003 (TW) ..... 92112272 A

(51) Int. Cl.
*H01J 9/00* (2006.01)
*H01J 1/88* (2006.01)

(52) U.S. Cl. ..... 445/24; 313/292

(58) Field of Classification Search ..... 313/293–296, 313/292; 445/24
See application file for complete search history.

(56) References Cited

U.S. PATENT DOCUMENTS 6,380,671 B1 * 4/2002 Lee ..... 313/495
6,534,911 B1 * 3/2003 Ando ..... 313/496
6,583,549 B1 * 6/2003 Takenaka et al. ..... 313/422
6,617,798 B1 * 9/2003 Lee et al. ..... 315/169.3
6,747,409 B1 * 6/2004 Han et al. ..... 313/582
6,756,729 B1 * 6/2004 Na et al. ..... 313/496
6,965,200 B1 * 11/2005 Kimura et al. ..... 313/582
2004/0135490 A1 * 7/2004 Lee et al. ..... 313/495

* cited by examiner

*Primary Examiner*—Karabi Guharay
*Assistant Examiner*—Dalei Dong
(74) *Attorney, Agent, or Firm*—Birch, Stewart, Kolasch & Birch, LLP

(57) ABSTRACT

A field emission display (FED) having a grid plate with spacer structure and fabrication method thereof. A first wplate having first electrodes and electron emitters on a first surface is provided. A second plate having second electrodes and phosphor regions on a second surface is also provided, wherein the second surface is opposite the first surface. A grid plate with spacer structure and passages having grid electrodes is positioned between the two plates to maintain a predetermined interval. When a specific voltage is applied between the first electrode and the second electrode, electrons extracted from the electron emitters are accelerated by the grid electrodes through the passages to impact the phosphor regions.

12 Claims, 6 Drawing Sheets

METHOD OF FABRICATING FIELD EMISSION DISPLAY HAVING A GRID PLATE

This nonprovisional application claims priority under 35 U.S.C. § 119(a) on Patent Application No. 092112272 filed in TAIWAN on May 6, 2003, which is herein incorporated by reference.

BACKGROUND OF THE INVENTION

1. Field of the Invention

The present invention relates to a field emission display (FED) and fabrication method thereof, and more specifically to a triode-type field emission display (FED) having a grid plate with spacer structure and fabrication method thereof.

2. Description of the Related Art

Field emission display (FED) is a kind of flat panel display attracting intense notice in recent years. The main reason is that it not only has the thin and light characteristics of a liquid crystal display (LCD), but also the high brightness and self emission advantages of cathode ray tube (CRT) displays.

FIG. 1*a* is a schematic diagram showing the structure of a conventional diode-type (cathode and anode) field emission display. According to the conventional diode-type field emission display 10, the anode electrode 18 provides a high voltage environment to attract electrons emitted from the emission source 12 formed on the cathode electrode 16 of a cathode plate 14, and the electrons impact the phosphor layer 23 on the anode plate 18 resulting in light emission. Since the maximum voltage difference between the cathode electrode 16 and the anode electrode 18 is only 600V, the conventional field emission display has disadvantages of short life span and low brightness.

To overcome the above drawbacks of the diode-type field emission display, a triode type (cathode, anode, and gate electrode) field emission display having high voltage difference has been disclosed. FIG. 1*b* is a schematic diagram showing the structure of a typical triode-type field emission display.

The main difference from the diode-type field emission display is an additional gate electrode 34. The gate electrode 34 is formed on an insulating layer 36 between the anode electrode 48 and the cathode electrode 40 to control the voltage, resulting in low voltage requirement of electrons emitted from the field emission source 38 of cathode plate 41. The voltage difference 47 between the anode electrode 48 and the cathode electrode 40 is then boosted to 4 KV, and the speed of electrons hitting the phosphor layer 49 formed on the anode plate 46 is increased.

However, in the manufacturing process of conventional gate-controlled triode field emission display 30, complicated and multiple photolithographic and etching steps have to be employed to precisely form the cathode electrode 40 and the gate electrode 34 on predetermined locations of the cathode plate 41 at the same time, and it is extremely difficult to prevent misregistration between the cathode electrode 40 and the gate electrode 34. As a result, the complicated manufacturing process of field emission display reduces throughput and yield.

U.S. Pat. No. 6,380,671 discloses a triode-type field emission display 50. As shown in FIG. 2, a grid plate 53 with a plurality of grid electrodes 55 and through-holes 60 is positioned between the anode plate 52 and the cathode plate 51, and spacers are erected between the grid plate 53 and each of the plates 52 and 54 to maintain a predetermined interval against the atmospheric pressure.

The grid electrodes 55 onto the grid plate 53 enhance the emission of electrons from the emission source 57 and accelerate the electrons passing through-holes 60 in the grid plate 53 to impact the phosphor layers formed on the anode plate 52. Compared with the conventional triode-type field emission display, the grid electrodes 55 are formed on the grid plate rather than on the same plate with cathodes, resulting in simplification of the manufacturing process of the field emission display.

However, since an additional grid plate 53 is positioned between the cathode plate 51 and anode plate 52, different lengths of spacers 62 and 64 have to be erected between the anode plate 52 and the grid plate 53, and between the cathode plate 51 and the grid plate 53 respectively. Due to the essential double spacer attachment processes in the manufacturing process of the field emission display, the number of spacers erected between each two plates is doubled, and the probability of misregistration is increased substantially. Processing time is increased and production is slowed resulting from the additional alignment and attachment processes for increased spacers, particularly in manufacturing process for large display.

While spacers are pre-positioned in desired positions on the grid plate used in another conventional manufacturing process, the additional alignment and attachment processes are performed while spacers are pre-positioned in desired positions on the grid plate. As a result, the manufacturing process still cannot reduce the processing time of spacer positioning and the probability of misregistration.

SUMMARY OF THE INVENTION

Accordingly, an object of the present invention is to provide a triode-type field emission display for which the manufacturing process is simplified and the throughput and yield are increased by use of a grid plate with spacer structure formed integrally therewith to separate the anode plate from the cathode plate, rather than conventional spacers.

Another object of the present invention is to provide a fabrication method of a field emission display to obtain a field emission display having a grid plate with spacer structure according to the present invention.

To achieve the first object, according to the present invention, a field emission display comprises a first plate having a first surface, and first electrodes and electron emitters formed on the first surface of the first plate. A second plate having a second surface opposite the first surface is provided, and second electrodes and phosphor regions are formed on the second surface of the second plate.

A grid plate with spacer structure has grid electrodes thereon and passages therethrough, being positioned between the first plate and the second plate to maintain a predetermined interval using overhangs of the spacer structure formed integrally with the grid plate. When a specific voltage is applied between the first electrode and the second electrode, electrons extracted from the electron emitters are accelerated by the grid electrodes through the passages to impact the phosphor regions.

The present invention also provides a fabrication method of a field emission display having a grid plate with spacer structure, including the following steps.

First, a first plate having a first surface is provided, with first electrodes and a plurality of electron emitters formed thereon.

Next, a second plate with a second surface opposite the first surface is provided, with second electrodes and a plurality of phosphor regions formed thereon.

Next, a grid plate having a plurality of first spacer overhangs, second spacer overhangs, grid electrodes, and passages is provided. The grid plate is positioned between the first plate and second plate to maintain a predetermined interval, wherein the grid plate is combined with the first plate through the first spacer overhangs acting as spacers and combined with the second plate through the second spacer overhangs acting as spacers.

When a specific voltage is applied between the first electrode and the second electrode, electrons extracted from the electron emitters are accelerated by the grid electrodes through the passages to impact the phosphor regions.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DETAILED DESCRIPTION OF THE INVENTION

The following embodiments are intended to illustrate the invention more fully without limiting the scope of the claims, since numerous modifications and variations will be apparent to those skilled in this art.

Figure 1A:
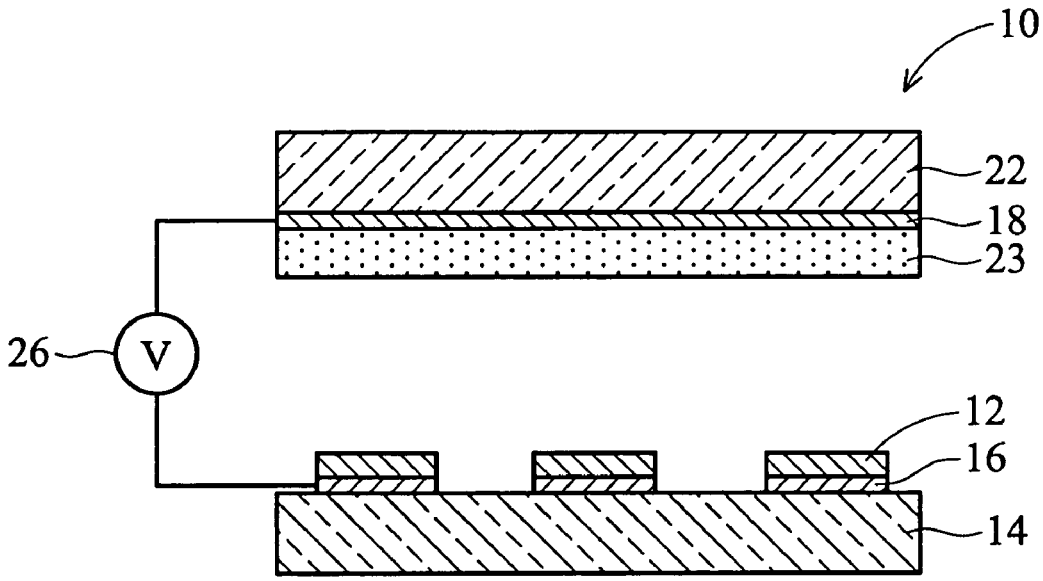
FIG. 1a (RELATED ART)
FIG. 1*a* is a cross-section illustrating a conventional diode-type field emission display.
Figure 1B:
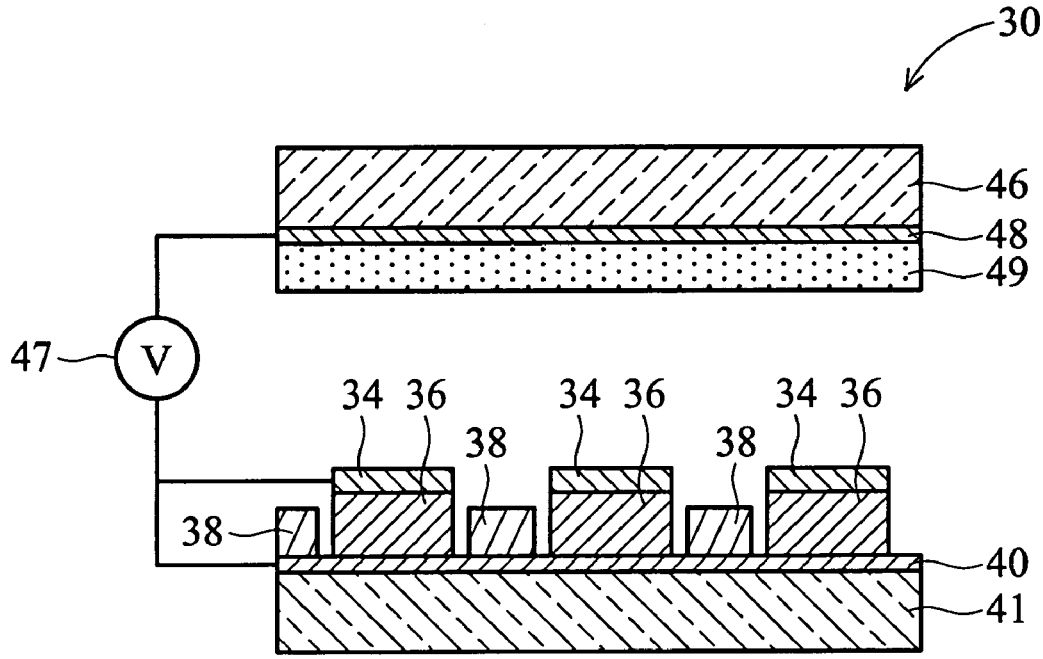
FIG. 1b (RELATED ART)
FIG. 1*b* is a cross-section illustrating a conventional triode-type field emission display.
Figure 2:
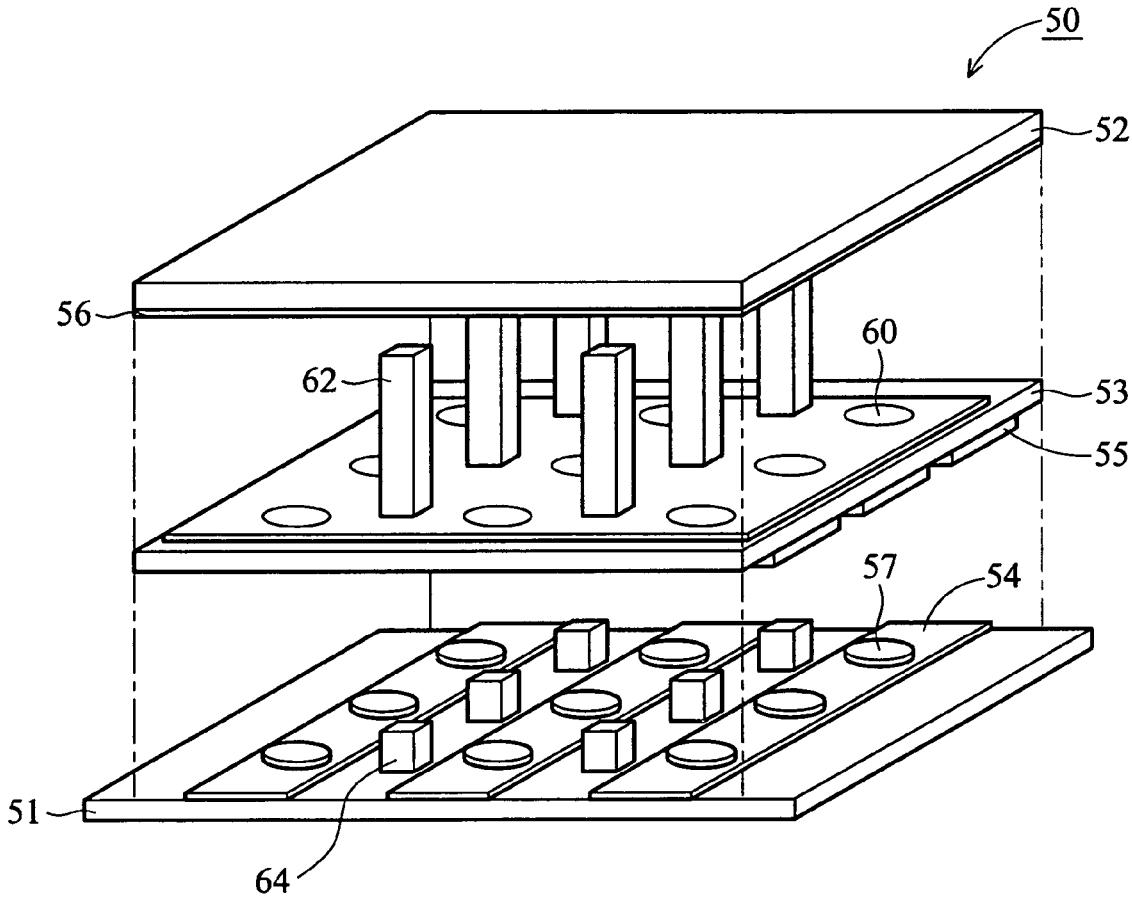
FIG. 2 (RELATED ART)
FIG. 2 is an exploded view of a conventional triode-type field emission display showing the attachment thereof.
Figure 3:
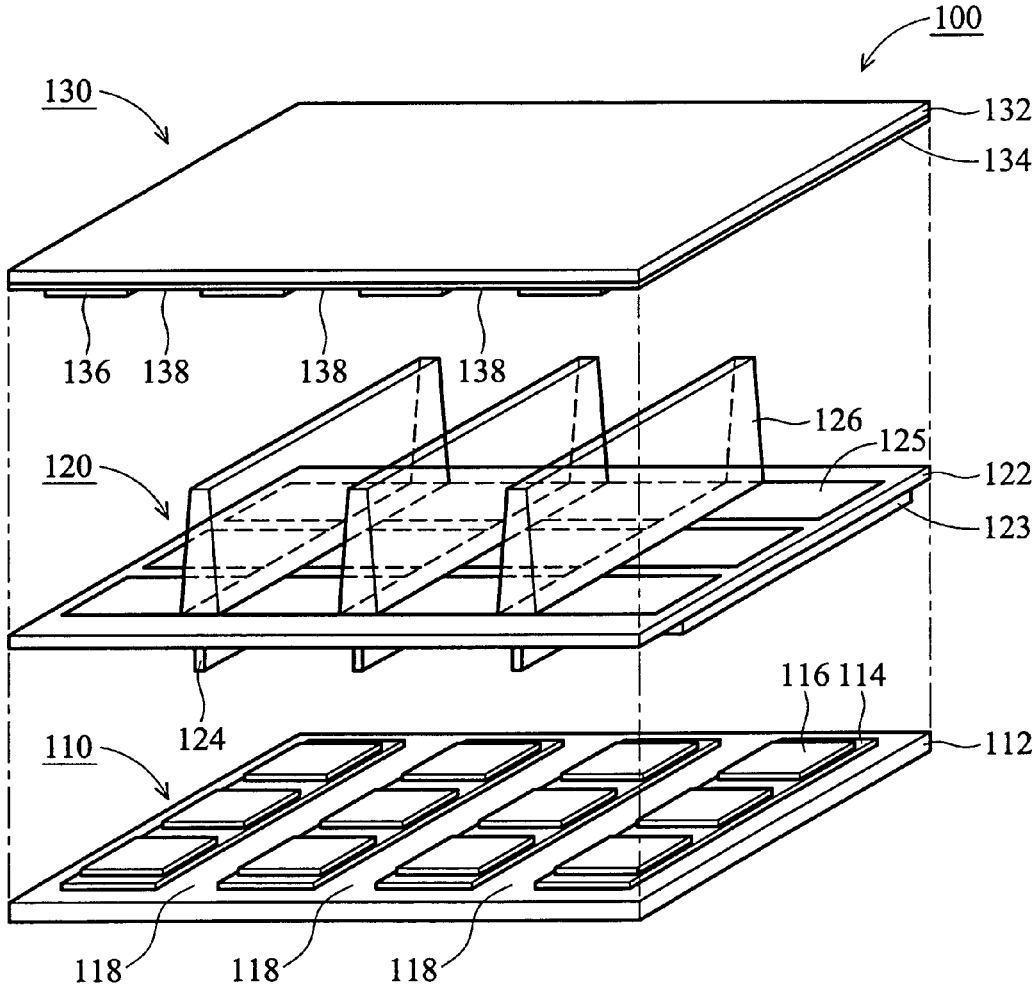
FIG. 3 is an exploded view of the field emission display in accordance with the present invention, showing the attachment thereof.

FIG. 3 is an exploded view of the field emission display having a grid plate with spacer structure in accordance with the present invention showing the attachment thereof.

The field emission display 100 includes a cathode plate 110, an anode plate 130, and a grid plate 120 having spacer structure. Herein, the term "grid plate having spacer structure" describes a grid plate having a plurality of overhangs on both upper and lower surfaces, wherein the overhangs are formed integrally with the grid plate and act as spacers in the attachment of field emission display.

Herein, the above cathode plate 110 includes cathode electrodes 114 and a plurality of electron emitters 116 formed thereon. The manufacturing process of the cathode plate 110 comprises forming the cathode electrodes 114 on an insulating substrate 112. Sequentially, electron emitters 116 are formed on the cathode electrodes 114, wherein the cathode electrodes 114 can be metal electrodes and formed optionally in any pattern. The electron emitters 116 are preferably nanotube emitter arrays, and more preferably carbon nanotube arrays. In addition, the electron emitters 116 are separated by first predetermined regions 118 to allow subsequent combination of the grid plate 120.

The above anode plate 130 includes a plurality of anode electrodes 134 formed thereon, and a plurality of phosphor regions 136 formed on the anode electrodes 134. The manufacturing process of the anode plate 130 comprises forming the anode electrodes 134 on a transparent substrate 132. The phosphor regions 136 are formed on the anode electrodes 134, wherein the transparent substrate 132 may be a glass substrate and a suitable material for anode electrode 134 may be indium tin oxide (ITO). In addition, the phosphor regions 136 are separate by a second predetermined region 138 to allow subsequent combination of the grid plate 120.

Referring to FIG. 3, the grid plate 120 according to the present invention is a substrate 122 having a plurality of first spacer overhangs 124, second spacer overhangs 126, and passages 125 therethrough, with a plurality of grid electrodes 123 formed on the same side as the first spacer overhangs 124 of the substrate 122. In the present invention, the first spacer overhangs 124 are positioned subsequently on the first predetermined regions 118, serving as spacers to combine the grid plate 120 with the cathode plate 110. The second spacer overhangs 126 are positioned subsequently on the second predetermined regions 138, serving as spacers to combine the grid plate 120 with the anode plate 130.

The substrate 122 serving as the grid plate 120 has a plurality of overhangs which maintain a predetermined interval between the cathode plate 110 and the anode plate 130 in the field emission display. As a main feature and a key aspect of the present invention, the substrate 122 having a plurality of overhangs and passages is integrally formed. Namely, the spacer overhangs 124 and 126 and passages 125 of the substrate 122 are formed simultaneously in the manufacturing process of the substrate 122.

Photosensitive glass or ceramic can be molded into the substrate 122 by photolithographic and etching processes. In a preferred embodiment, pre-designed patterned mask layers are formed on a commercially available photosensitive glass, FOTURAN (available from mikroglas technik AG).

Subsequently, the photosensitive glass is exposed to ultraviolet light with a wavelength of 290–330 nm. With the UV exposure step, silver atoms of the photosensitive glass are released from the illuminated areas.

After exposure, the photosensitive glass is baked at 400~500° C. During the heat treatment, the illuminated areas of the photosensitive glass crystallize around the silver atoms. The crystalline regions, when etched with an acid at room temperature, such as 10% solution of hydrofluoric acid, have an etching rate higher than that of the vitreous regions. If wet chemical etching is supported by ultrasonic or spray etching, the resulting structures display a large aspect ratio.

Optional repeat of the above steps completes the fabrication of the substrate 122 having a plurality of spacer overhangs 124 and 126 and passages 125 according to the present invention.

As well, another fabrication method comprises the substrate 122 having a plurality of spacer overhangs and passages being molded from photostructurable glass or ceramic by 3D laser exposure.

In another preferred embodiment, multiple laser lights volumetrically pattern a photostructurable material, such as a photoceram, via direct-write processing. The multiple laser lights, with wavelength from 248 to 355 nm, permit varied penetration depth of the ultraviolet light and determine the effective height of the microstructure being patterned.

Through an exposure, the laser light remains stationary and the photoceram is moved partially to produce the desired pattern. To implement the 3D Laser exposure process, a computer program, such as a CAD-CAM soft, is used to control the path and pattern of the incident laser lights.

Furthermore, plastic materials, such as dielectric, plastic, glass, or ceramic, can be used to form the integrally formed substrate 122 having spacer overhangs through molding techniques in other podssible embodiments of the present invention.

After fabrication of the substrate 122, a plurality of grid electrodes 123 are formed thereon to obtain the grid plate 120 according to the present invention, the grid electrodes 123 located on either side of the first spacer overhangs 124 adjacent to the passages 125. Preferably, the grid electrodes 123 are formed by sputtering, electron beam evaporation, thermal evaporation, or chemical vapor deposition, and patterned by photolithography.

Figure 4A:
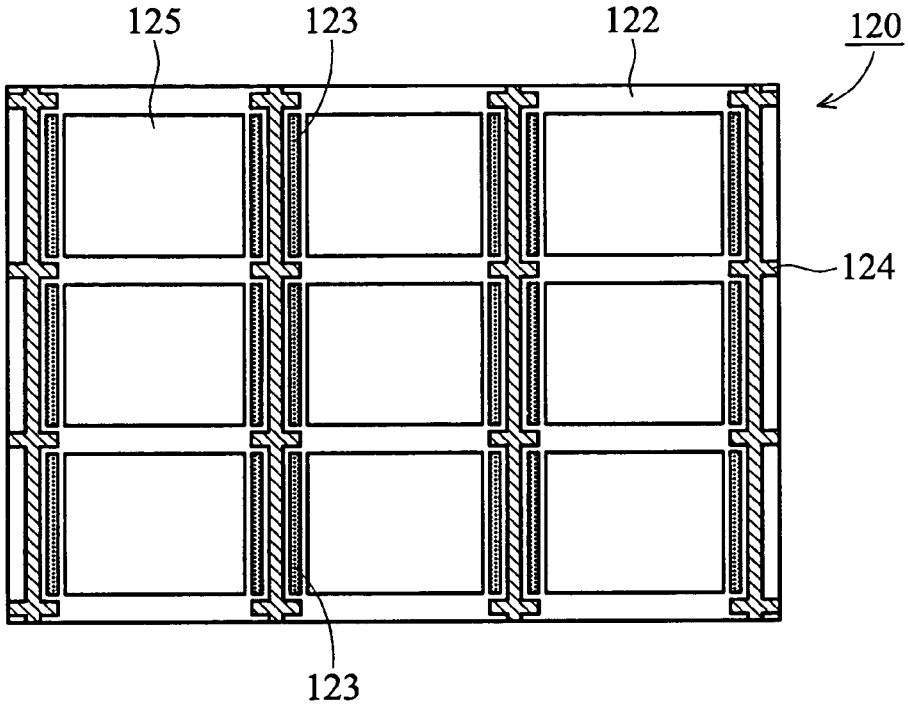
FIGS. 4*a* and 4*b* are schematic bottom views of the grid plate in accordance with the present invention.
Figure 4B:
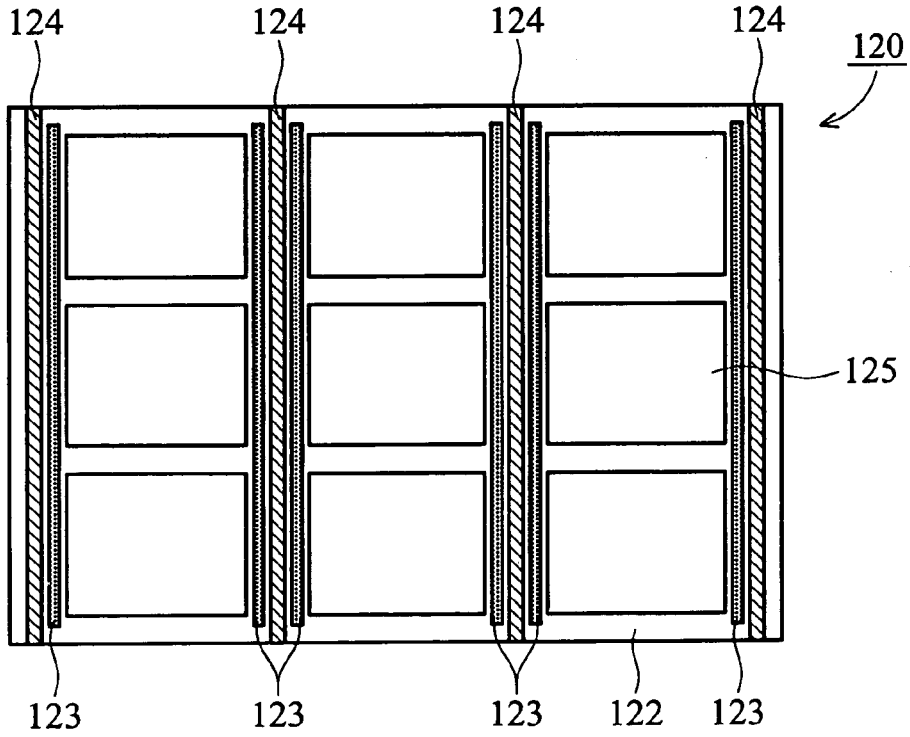

FIG. 4*a* is a schematic bottom view of the grid plate 120, viewed from the side of the first spacer overhangs 124, showing the relationship between the grid electrodes 123, the first spacer overhangs 124, and the passages 125. FIG. 4*b* is a schematic bottom view in accordance with another embodiment of the present invention.

Figure 5A:
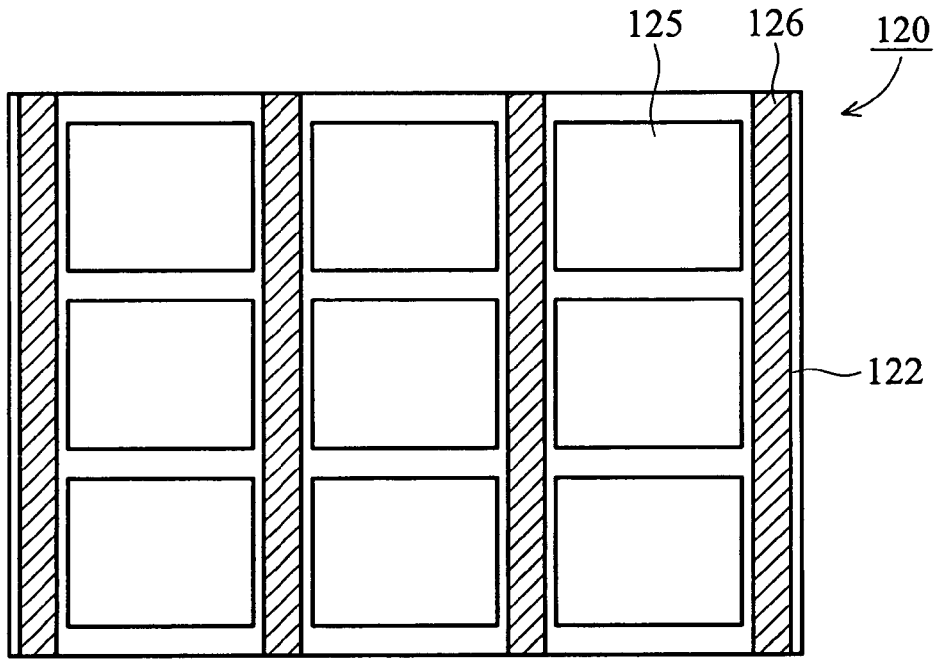
FIGS. 5*a* and 5*b* are schematic top views of the grid plate in accordance with the present invention.

FIG. 5*a* is a schematic top view of the grid plate 120 in accordance with another preferred embodiment of the present invention, viewed from the side of the second spacer overhangs 126, showing the relationship between the second spacer overhangs 126 and the passages 125.

Figure 5B:
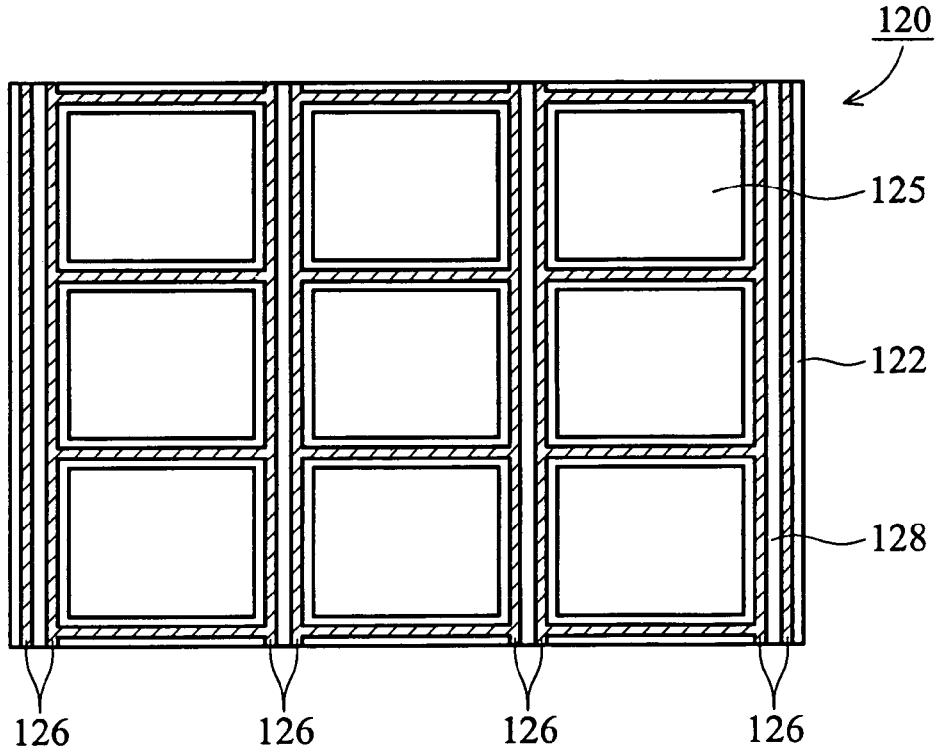

In another preferred embodiment as shown in FIG. 5*b*, the substrate 122 has a plurality of trenches, separating the second spacer overhangs, serving as exhaust channels 128, facilitating the vacuum exhaust in the sealing process of the field emission display to avoid the field emission electrons being affected by residual gas. The exhaust channels 128 can be formed simultaneously in the manufacturing process of the substrate 122.

After the fabrications of the cathode plate 110 according to the present invention, the grid plate 120, and the anode plate 130 according to the methods mentioned above, the above three plates are aligned and attached. As shown in FIG. 3, the grid plate 120 is positioned between the cathode plate 110 and anode plate 130 to maintain a predetermined interval, wherein the grid plate 120 is combined with the cathode plate 110 by attaching the first spacer overhangs 124 to the first determined region 118, and with the anode plate by attaching the second spacer overhangs 126 to the second determined region 118.

Figure 6A:
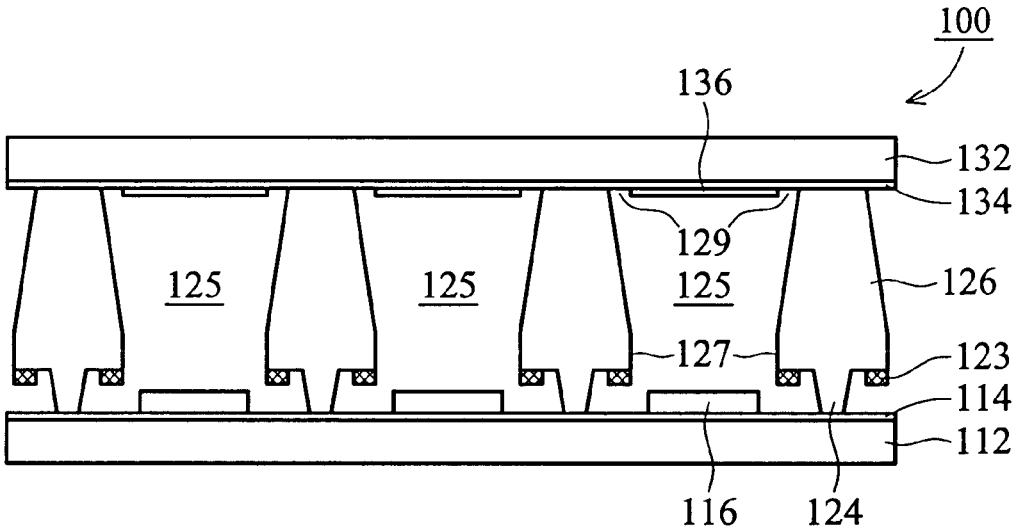
FIGS. 6*a* and 6*b* are cross-sections illustrating the present invention.

After alignment and attachment, a sealing process, such as tubeless vacuum packing, is used to package the structure to obtain the field emission display 100 according to the present invention. FIG. 6*a* is a cross-section of the field emission display according to a preferred embodiment.

In the present invention, the interval of the anode plate 130 between two second spacer overhangs 126 positioned thereon is defined as an anode contact window 129, and the interval of the passage between the locations of the grid electrodes on either side of the electron emitter 116 is defined as an electron emitting window 127. One aspect of the invention, the anode contact window 129 can be designed larger than the phosphor region 136 to facilitate vacuum exhaust in the sealing process.

Figure 6B:
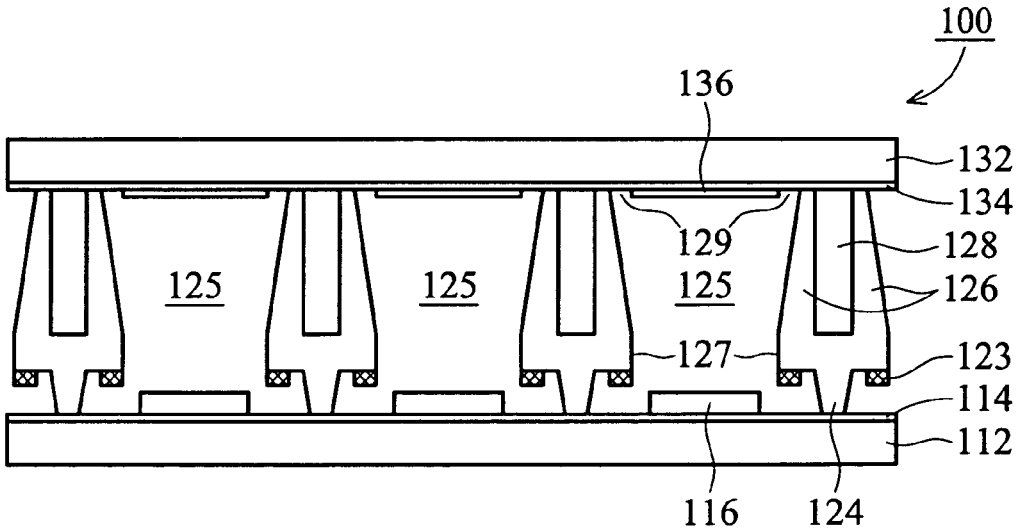

Another aspect of the invention, the electron emitting window 127, can be designed larger than the anode contact window 129 to lower the operational voltage of the grid electrodes 123, as shown in FIG. 6*b*.

In the present invention, the fabrication method of field emission display allows a large screen field emission display without the conventional complicated process by separately providing a cathode layer and a grid layer. The grid and cathode electrodes are fabricated separately, forming the grid electrodes on the grid plate, allowing the complicated multiple photolithographic and etching formation of the cathode electrodes and the grid electrodes on one side of the cathode plate to be avoided.

Moreover, the fabrication method of the field emission display according to the present invention allows formation of electron emitters onto the cathode electrodes directly, and, as a result, is suitable for fabricating a field emission display having carbon nanotube films as electron emitters.

Furthermore, the grid plate having a plurality of overhangs serving as spacers of field emission display is formed integrally. Compared with the conventional triode-type field emission display, alignment and attachment used in fabricating the field emission display according to the present invention are simplified substantially resultingly. Accordingly, throughput and yield for the field emission display according to the present invention are improved.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A fabrication method of a field emission display having a grid plate with spacer structure, comprising:

providing a first plate having a first surface;

forming first electrodes on the first surface of the first plate and electron emitters on the first electrodes;

providing a second plate having a second surface opposite the first surface;

forming second electrodes on the second surface of the second plate and phosphor regions on the second electrodes;

providing a grid plate having first spacer overhangs, second spacer overhangs, passages, and grid electrodes, wherein the each second spacer overhangs has an exhaust channel therein; and positioning the grid plate between the first plate and second plate to maintain a predetermined interval, wherein the grid plate is combined with the first plate by the first spacer overhangs and combined with the second plate by the second spacer overhangs.

2. The method as claimed in claim 1, wherein the grid plate having first spacer overhangs, second spacer overhangs, and passages, is integrally formed.

3. The method as claimed in claim 1, wherein the grid plate having first spacer overhangs, second spacer overhangs, and passages, is photosensitive glass or ceramic.

4. The method as claimed in claim 3, wherein the grid plate is formed by photolithographic and etching processes.

5. The method as claimed in claim 1, wherein the grid plate having first spacer overhangs, second spacer overhangs, and passages, is photostructurable glass or ceramic.

6. The method as claimed in claim 5, wherein the grid plate is formed by 3D laser exposure process.

7. The method as claimed in claim 1, wherein the grid plate having first spacer overhangs, second spacer overhangs, and passages is dielectric, plastic, glass, or ceramic.

8. The method as claimed in claim 7, wherein the grid plate is formed by molding.

9. The method as claimed in claim 1, wherein the grid electrons formed on the grid plate are located on either side of the first spacer overhangs opposite the first surface.

10. The method as claimed in claim 1, wherein the first surface comprises second electrode contact windows between two adjacent second spacer overhangs located thereon, and the second electrode contact window is larger than the relative phosphor region.

11. The method as claimed in claim 10, wherein the passage comprises an electron emitting window between the locations of the grid electrodes on either side of the electron emitter, and the electron emitting window is larger than the relative second electrode contact window.

12. The method as claimed in claim 1, wherein the electron emitter is a carbon nanotube array.

* * * * *